United States Patent [19]

Stewart

[11] Patent Number: 4,716,815

[45] Date of Patent: Jan. 5, 1988

[54] FLUID-PRESSURE-OPERATED ACTUATORS

[75] Inventor: Duncan R. Stewart, Newent, England

[73] Assignee: Hytork Actuators Limited, Gloucester, England

[21] Appl. No.: 601,447

[22] Filed: Apr. 18, 1984

[30] Foreign Application Priority Data

Apr. 23, 1983 [GB] United Kingdom ..... 8311117

[51] Int. Cl.[4] ..... F15B 11/08

[52] U.S. Cl. ..... 91/464; 92/131; 251/250

[58] Field of Search ..... 92/13.1, 13.5, 13.6, 92/136, 127, 130 R, 130 A, 131, 134, 135, ; 91/174, 509, 510, 390, 462, 464; 251/250

[56] References Cited

U.S. PATENT DOCUMENTS

| | | | |
|---|---|---|---|
| 1,649,356 | 11/1927 | Louis | 417/471 |
| 2,777,427 | 1/1957 | Nichols | 92/136 |
| 2,924,200 | 2/1960 | Hanna et al. | 91/464 X |
| 3,104,862 | 9/1963 | Pearson et al. | 251/250 X |
| 3,476,220 | 11/1969 | Kobayashi | 92/129 |
| 3,709,098 | 1/1973 | Lloyd | 92/136 |
| 4,143,583 | 3/1979 | Bauer et al. | 91/509 |

FOREIGN PATENT DOCUMENTS

| | | | |
|---|---|---|---|
| 3019821 | 1/1981 | Fed. Rep. of Germany | 92/136 |
| 771762 | 4/1957 | United Kingdom | 92/131 |
| 1518931 | 7/1978 | United Kingdom | 92/136 |
| 0731093 | 4/1980 | U.S.S.R. | 92/136 |

*Primary Examiner*—Edward K. Look

*Attorney, Agent, or Firm*—William R. Hinds

[57] ABSTRACT

A fluid-pressure-operated actuator is arranged to have three set positions and preferably a fail-safe characteristic in one of the three positions. In one embodiment an H-section piston moves in an actuator body and is set in its two extreme positions by fluid pressure introduced behind the web of the piston through one or other of spindles having heads and bores. To set the intermediate position, annular pistons can be moved along the spindles by pressure introduced at inlet pipes in the body until those pistons contact the heads of the spindles. The spindles are adjustable in the body to set the intermediate position of the piston and adjusting bolts set the extreme positions of the piston. For a fail-safe situation, a reservoir and control valve are introduced. As an alternative to annular pistons springs acting through top-hat shaped buffers can be used giving a fail-safe situation in the intermediate position of the piston.

20 Claims, 7 Drawing Figures

FLUID-PRESSURE-OPERATED ACTUATORS

This invention relates to fluid-pressure-operated actuators.

Actuators, such as required for example for the remote operation of valves and other mechanisms, tend to have two operative positions which reside at the extremes of the stroke of the piston of the actuator.

There is a demand for actuators having three operative positions. For example a 3-way valve, to be remotely operated, would typically require having its operating spindle set at 0°, 90° and 180°. Other settings may also be required extending over a range of say 270° or 360° or more than 360°. There is a further demand, as with conventional two-position actuators, to have the ability to create a fail safe situation and it is a desirable additional objective to have the fail-safe position identified against a selected one of the three operative positions.

According to this invention a fluid-pressure-operated actuator comprises a cylinder, a hollow piston movable in the cylinder, a first inlet for supplying fluid pressure to the cylinder interior on one side of the piston to move the piston in one sense, a second inlet for supplying fluid pressure to the cylinder interior on the other side of the piston to move the piston in the opposite sense, and means cooperable with the piston to set the piston in a selected one or other of three positions.

In one form said means comprises a return spring pair acting on the piston in opposition so that, in the absence of fluid pressure, the piston is moved to a said position between the other two of said positions by either one or other of the springs and is set in that position by both springs and is set in one of said two positions with one of said springs acting compressed on the piston and the other said springs confined so as not to act on the piston and is set in the other of said two positions with said other of said springs acting compressed on the piston and said one of said springs confined so as not to act on the piston.

Said piston may be of H-section so as to have a web and has a rack between end seals on an external wall of the piston, said rack coupling with a pinion driving an output shaft having an axis at right angles to the line of movement of the piston, and the springs act on the web of the H-shaped piston through the medium of top-hat shaped buffer members respectively inside the piston on opposite sides of the web, said buffer-members being movable on buffer stop members, said stop members being adjustable to define the limit of expansion of the springs and to set said position of the piston in the absence of fluid pressure.

There may be adjustable end stops in the cylinder for defining and adjusting the two said positions.

In another form said means comprises annular pistons respectively engageable with the piston and movable on spindles mounted in the cylinder, said spindles having portions engageable with the respective annular piston for limiting movement of the annular piston towards the other annular piston, third and fourth inlets for supplying fluid pressure respectively to the sides of the annular pistons remote from the web, said annular pistons being disposed such that with the volume between the web of the piston and one annular piston pressurised the piston sets at one extreme position of movement, with the volume between the web and the other annular piston pressurised the piston sets at the other extreme position of movement, and with the volumes between the annular pistons and the cylinder pressurised the piston sets at a said position between said extreme positions by confinement imposed by the annular pistons. The annular pistons may be engageable with the ends of the piston, or with the piston internally of the piston e.g. with the web of the piston.

Said actuator may be rendered to fail safe at a selected one of said positions by virtue of a control device comprising introducing means for storing fluid pressure, and means for stored pressure from said storing means at an appropriate one of said fluid pressure inlets when normal supply pressure to the actuator fails.

Said introducing means may comprise valve means held in a first condition by supply pressure, and means for moving the valve means to a second condition when said supply pressure fails, said valve means in the second condition supply stored pressure to said one inlet.

Various actuators according to the invention satisfying certain or all of the above-stated demands will now be described by way of example with reference to the accompanying drawings in which:

FIG. 1 shows a longitudinal sectional view of a 3-position actuator with flow lines and control valves;

FIGS. 1A, B and C are diagrams representing the three states of operation of the actuator of FIG. 1;

Figure 1:
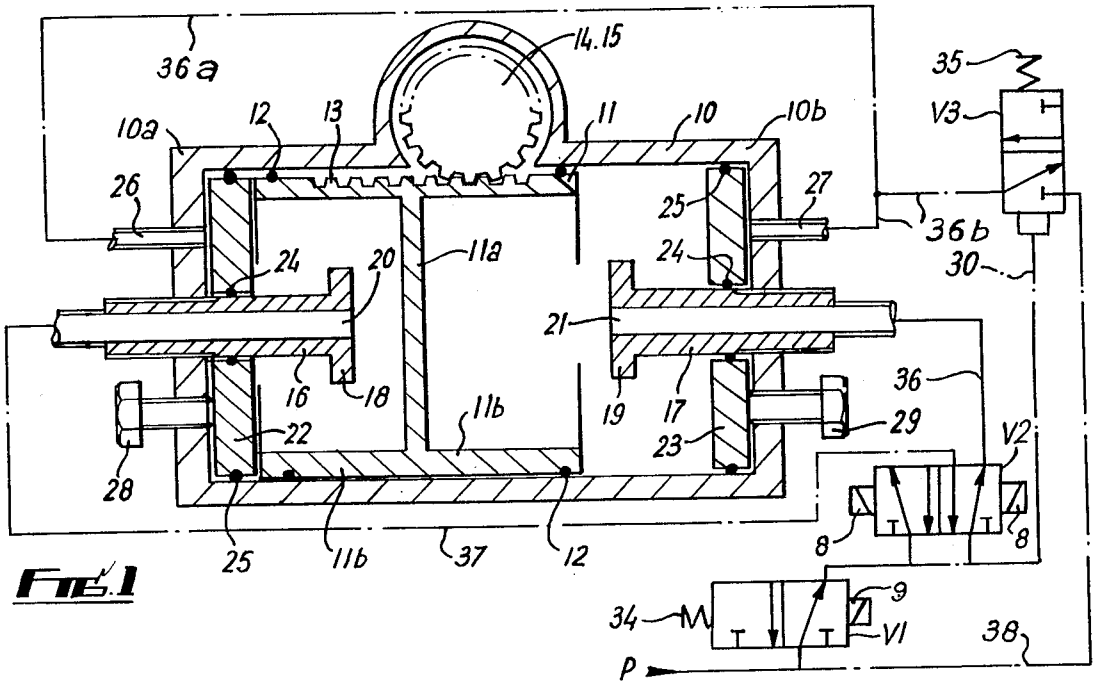
Figure 1C:
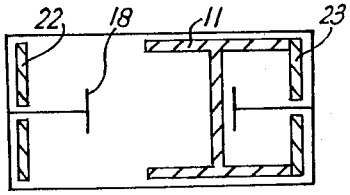

In FIG. 1 an actuator body 10 functions as a cylinder for an H-section piston 11 having annular seals 12, a web part 11*a* and cylindrical part 11*b*. The piston 11 has an exterior rack 13 machines into the wall within the nominal wall dimensions of the piston and located between the seals. The rack 13 engages with a pinion (or partial pinion) 14 on a rotary operating shaft 15 extending exteriorly of the body 10.

The end walls 10*a*, 10*b* of the body 10 are centrally penetrated by spindles 16, 17 having respective heads 18, 19. The spindles 16, 17 have respective axial bores 20, 21. The spindles are axially adjustable in position in the body ends. The spindles carry respectively annular pistons 22, 23 engageable with the ends of the piston 11 and each having radially inner and outer annular seals 24, 25. The end walls are also penetrated by fluid inlet pipes 26, 27 and adjusting bolts 28, 29.

The actuator is associated with a fluid pressure supply P which connects via three control spool valves V1, V2 and V3 to the inlet pipes 26, 27 and the bores 20, 21, valves V1, V3 being biassed in one sense by springs 34, 35. For example, valve V1 is operable in the opposite sense by solenoid 9 and valve V2 is operated in opposed directions by solenoids 8.

As shown in FIG. 1 (and FIG. 1A) the supply P is connected via valves V1 and V2 to the bore 21 via line 36 so that the right hand side of piston 11 is pressurised whilst the left hand side is connected to exhaust via bore 20, line 37 and valve V2. A pressure sustained at valve V3 along line 30 ensures that pipes 26, 27 are exhausted through lines 36*a*, 36*b* and valve V3. The piston 11 takes up its extreme left position as determined by bolt 28 and is set or held in that position by fluid pressure.

If the valve V2 is now operated to its alternative position then the bore 20 receives supply pressure via line 37 and the right hand side of piston 11 is connected to exhaust via line 36 and bore 21. The piston 11 thus moves to its extreme right position (FIG. 10) as determined by bolt 29.

Figure 1B:
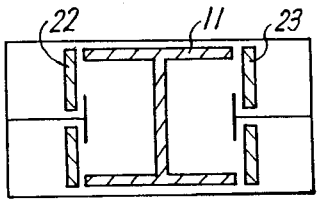
Figure 1A:
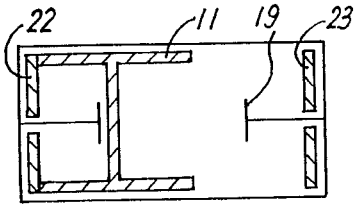

If the valve V1 is now operated to its alternative position under action of its spring 34 then both sides of the piston 11 become connected to exhaust, pressure is removed from line 30, and the spring 35 on valve V3 moves the spool of that valve so that supply pressure is connected via line 38 and valve V3 and thence to pipes 26, 27 so that pistons 22, 23 move against the heads 18, 19 of the spindles 16, 17 and take the piston 11 to its centre position (FIG. 1B). By positional adjustment of the spindles 16, 17, and hence the heads 18, 19, the centre position of piston 11 can be accurately defined. By positional adjustment of bolts 28, 29 the extreme positions of the piston 11 can also be accurately defined.

Figure 2:
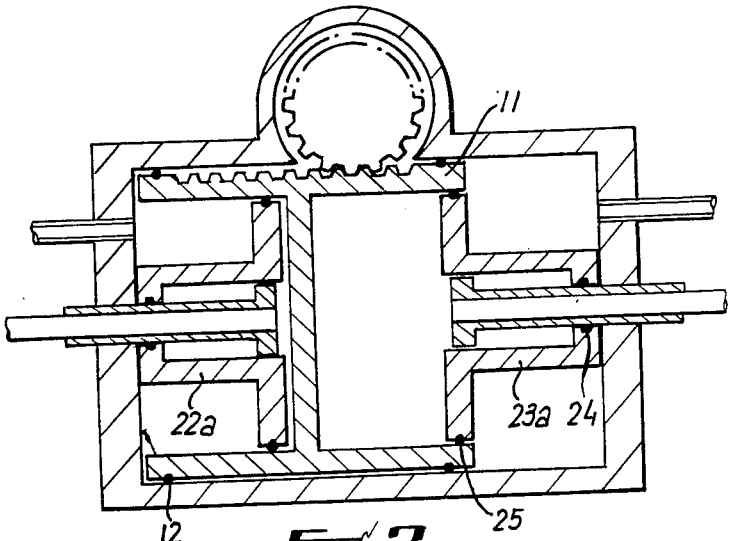
FIG. 2 shows an alternative construction of the actuator of FIG. 1.

In FIG. 2, a modification relative to FIG. 1 is shown in which the pistons 22, 23 of FIG. 1 are now formed to have a "top-hat" shape 22*a*, 23*a* and move inside the hollow bore of the piston 11.

Figure 3:
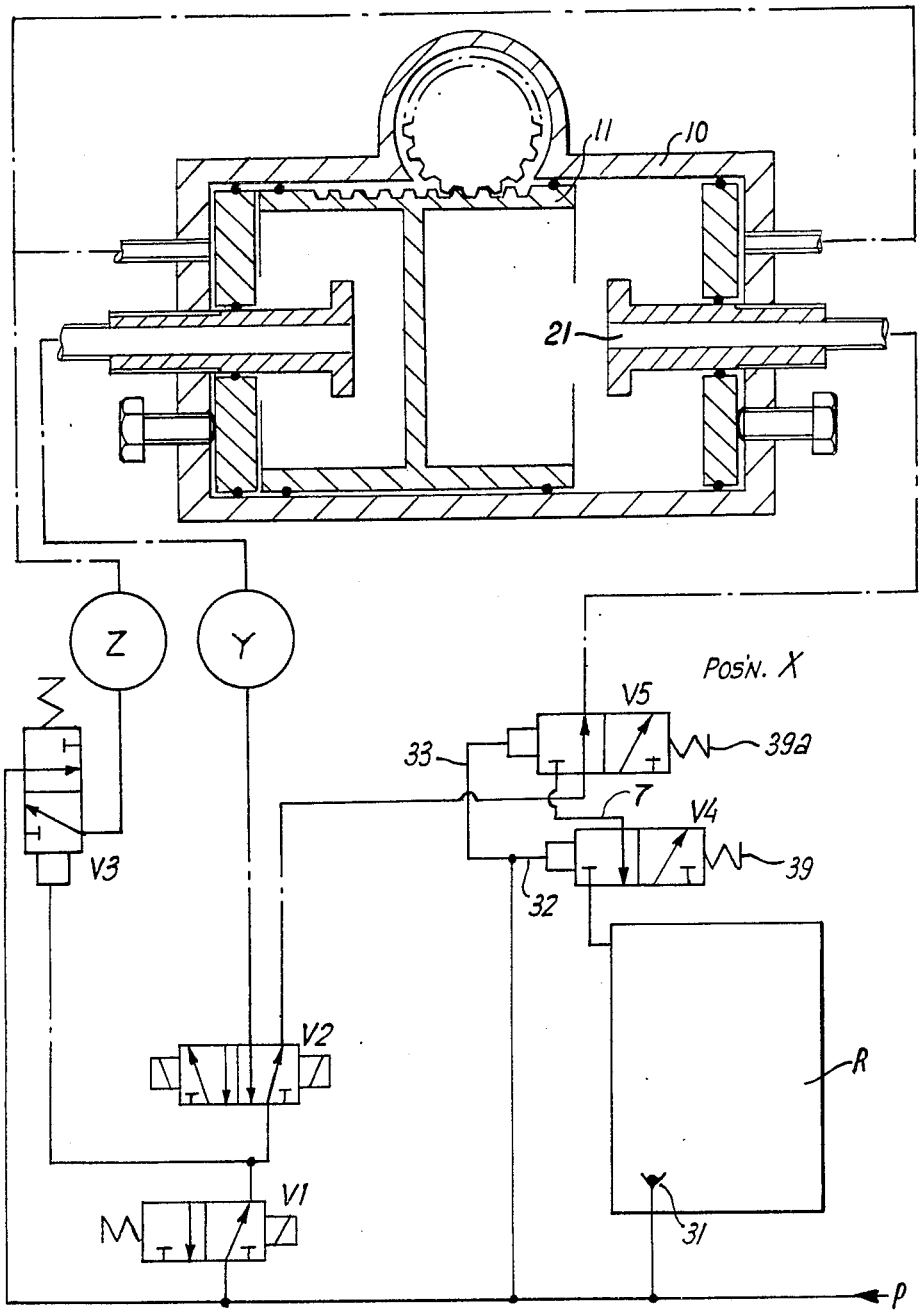
FIG. 3 shows an actuator like that in FIG. 1 but with flow lines, control valves, and fail-safe facilities; the fail-safe position being selectable.

FIG. 3 shows the same actuator as in FIG. 1 but with different operating fluid control to give fail-safe facilities which are selectable in position. To this end a reservoir R is provided having non-return valve 31 to the pressure supply P.

A valve V4 is held in a position against a spring 39 by supply pressure P in a line 32 so that the reservoir R is not associated with the actuator operation until supply P fails. In this event the spring in valve V4 moves the spool of valve V4 so that reservoir pressure appears at a valve V5 via line 7. (Valve V5 in its normal condition takes supply pressure via valves V1 and V2—as in FIG. 1—and couples it with bore 21). Valve V5 is also held in a position against a spring 39*a* by supply pressure P in a line 33 so that when supply pressure fails the spring in valve V5 moves the spool of valve V5 so that reservoir pressure appears at bore 21 and sets the piston 11 at its left hand extreme.

Valve V5 could alternatively be positioned at the position indicated by the circle Y or the circle Z. In the former position the actuator would fail safe with the piston 11 set at its right hand extreme and in the latter position with the piston 11 set centrally.

Figure 4:
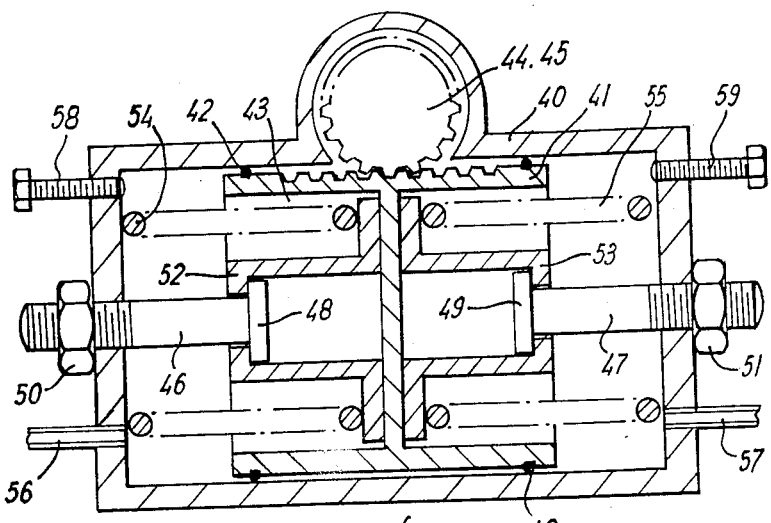
FIG. 4 shows a longitudinal sectional view of a 3-position actuator having a spring arrangement to give "fail-safe" facilities to the central position.

In FIG. 4 a valve actuator body 40 contains an H-section piston 41 having annular seals 42. An exterior rack 43 on the piston co-operates with a pinion 44 on a shaft 45 extending exteriorly of the body. The ends of the body 40 are penetrated by stop members 46, 47 having respective heads 48, 49. The members 46, 47 are respectively axially adjustable in position in the body ends and can be locked in position with nuts 50, 51. The spindles respectively support "top-hat" shaped buffers 52, 53 which are respectively loaded by springs 54, 55. The body ends are also penetrated by fluid inlet pipes 56, 57 and adjusting bolts 58, 59.

In operation and unpressurised the springs 54, 55 retain or set the piston 41 in the central position. This is, in fact, a fail-safe position. WIth inlet 57 pressurised, and inlet 56 exhausted, the piston 41 is caused to move to the left and in doing so the spring 54 is compressed and spring 55 is confined but does not act on the piston. Both springs act on buffers 52, 54, and thus on piston 11, over a range of movement on both sides of the centre position shown, the range of movement being determined by spindles 46, 47. With inlet 56 pressurised, and inlet 57 exhausted, the piston 41 is caused to move to the right and in doing so spring 55 is compressed and spring 54 confined. On failure of pressure, the springs return the piston to the central position. The end positions of the piston 11 can be adjusted by bolts 58, 59 and the centre or intermediate position can be set or adjusted by adjusting spindles 46, 47.

The actuator can be used in conjunction with mechanisms such as scotch yokes or cam arrangements.

I claim:

1. A fluid-pressure operated actuator comprising a cylinder, a piston having hollow axial end chambers and a transverse web intermediate said chambers, said piston movable in the cylinder, a first inlet for supplying fluid pressure to the cylinder interior and the piston end chamber on one side of the piston web to move the piston in one sense, a second inlet for supplying fluid pressure to the cylinder interior and the piston end chamber on the other side of the piston web to move the piston in the opposite sense, and means cooperable with the piston to set the piston in a selected one or other of three axially spaced predetermined positions, said last mentioned means including first and second elements axially movable in said cylinder respectively on opposite sides of the web, an intermediate one of the three positions being defined by engagement of said piston with said first and second elements, and means limiting the inward movement of at least one of said first and second elements to establish said intermediate position.

2. An actuator as claimed in claim 1, in which said cooperable means comprises a return spring pair acting on the piston in opposition so that, in the absence of fluid pressure, the piston is moved to said intermediate position between the other two of said three positions by either one or other of the springs and is set in that intermediate position by both springs and is set in one of said two positions with one of said springs acting compressed on the piston and the other said springs confined so as not to act on the piston and is set in the other of said two positions with said other of said springs acting compressed on the piston and said one of said springs confined so as not to act on the piston.

3. An actuator as claimed in claim 2, in which the piston is of H-section so as to have said web and has a line of movement and has a rack between end seals on an external wall of the piston, said rack coupling with a pinion driving an output shaft having an axis at right angles to the line of movement of the piston, and the springs act on the web of the H-shaped piston through the medium of top-hat shaped buffer members forming said first and second elements and respectively inside the piston on opposite sides of the web, said buffer-members being movable on buffer stop members, said stop members being adjustable to define the limit of expansion of the springs and to set said intermediate position of the piston in the absence of fluid pressure.

4. An actuator as claimed in claim 2, including adjustable end stops in the cylinder for defining and adjusting the two said positions.

5. A fluid-pressure-operated actuator comprising a cylinder, a piston having hollow axial end chambers and a transverse web intermediate said chambers, said piston movable in the cylinder, a first inlet for supplying fluid pressure to the cylinder end chamber on one side of the piston web to move the piston in one sense, a second inlet for supplying fluid pressure to the cylinder end chamber on the other side of the piston web to move the piston in the opposite sense, and means cooperable with the piston to set the piston in a selected one or other of three axially spaced predetermined positions, first and second elements axially movable in said cylinder respectively on opposite sides of the web, an intermediate one of the three positions being defined by engagement of said piston with said first and second elements, in which said piston is of H-section so as to have said web, and said cooperable means comprises annular pistons forming said first and second elements respectively engageable with the piston and movable on relatively fixed spindles mounted in the cylinder, said spindles having portions engageable with the respective annular piston for limiting movement of the annular piston towards the other annular piston, third and fourth inlets for supplying fluid pressure respectively to the sides of the annular pistons remote from the web, said annular pistons being disposed such that with the volume between the web of the piston and one annular piston pressurised the piston sets at one extreme position of movement, with the volume between the web and the other annular piston pressurised the piston sets at the other extreme position of movement, and with the volumes between the annular pistons and the cylinder pressurised the piston sets at said intermediate position between said extreme positions by confinement imposed by the annular pistons.

6. An actuator as claimed in claim 5, in which the annular pistons are respectively engageable with the ends of the pistons.

7. An actuator as claimed in claim 5, in which the annular pistons are respectively engageable with the piston internally of the piston.

8. A piston as claimed in claim 7, in which the annular pistons are engageable with the web of the piston.

9. An actuator as claimed in claim 5, including end stops adjustably mounted in the cylinder for defining the two extreme piston positions.

10. An actuator as claimed in claim 5, rendered to fail safe at a selected one of said positions by virtue of a control device comprising means for storing fluid pressure, and means for introducing stored pressure from said storing means at an appropriate one of said fluid pressure inlets in response to failure of normal supply pressure to the actuator.

11. A fluid-pressure-operated actuator comprising a cylinder, a piston having hollow axial end chambers and a transverse web intermediate said chambers, said piston movable in the cylinder, a first inlet for supplying fluid pressure to the cylinder interior and the piston end chamber on one side of the piston web to move the piston in one sense, a second inlet for supplying fluid pressure to the cylinder interior and the piston end chamber on the other side of the piston web to move the piston in the opposite sense, and means cooperable with the piston to set the piston in a selected one or other of three axially spaced predetermined positions, first and second elements axially movable in said cylinder respectively on opposite sides of the web, an intermediate one of the three positions being defined by engagement of said piston with said first and second elements, said actuator being rendered to fail safe at a selected one of said positions by virtue of a control device comprising means for storing fluid pressure, and means for introducing stored pressure from said storing means at an appropriate one of said fluid pressure inlets in response to failure of normal supply pressure to the actuator.

12. An actuator as claimed in claim 10, in which said introducing means comprises valve means held in a first condition by supply pressure, and means for moving the valve means to a second condition when said supply pressure fails, said valve means in the second condition supplying stored pressure to said one inlet.

13. An actuator as claimed in claim 11, in which said introducing means comprises valve means held in a first condition by supply pressure, and means for moving the valve means to a second condition when said supply pressure fails, said valve means in the second condition supplying stored pressure to said one inlet.

14. An actuator as claimed in claim 5, comprising bores through said spindles, said bores forming said first and second inlets.

15. An actuator as claimed in claim 1, comprising a rack on the exterior of the piston cooperable with a rotary output shaft extending exteriorly of the cylinder.

16. An actuator as claimed in claim 1, in which a stop is mounted in an end face of the cylinder, one of said first and second elements engaging said stop in said intermediate position of said piston.

17. An actuator as claimed in claim 16, in which said stop is axially adjustable in said end face.

18. An actuator as claimed in claim 1, including first and second stops respectively mounted in opposite end faces of said cylinder, said first and second elements respectively engaging said first and second stops in said intermediate position of said piston.

19. An actuator as claimed in claim 18, in which said first and second stops are axially adjustable in said opposite end faces.

20. An actuator as claimed in claim 1 further comprising end stops respectively in the end faces of the cylinder and engageable respectively with said first and second elements at respective axial end positions of said three positions to define said end positions, said end stops being axially adjustable.

* * * * *